US006418642B1

(12) United States Patent
Bigg et al.

(10) Patent No.: US 6,418,642 B1
(45) Date of Patent: Jul. 16, 2002

(54) SLIPPER WITH POLYMER INSOLE JELL AND METHOD FOR MANUFACTURING

(75) Inventors: Donald M. Bigg, Columbus; Walter Thomas Bray, Jr., Reynoldsburg; Theresa Stewart, Columbus, all of OH (US)

(73) Assignee: R. G. Barry Corporation, Pickerington, OH (US)

( * ) Notice: Subject to any disclaimer, the term of this patent is extended or adjusted under 35 U.S.C. 154(b) by 0 days.

(21) Appl. No.: 09/480,417

(22) Filed: Jan. 11, 2000

(51) Int. Cl.[7] ..... A43B 13/12

(52) U.S. Cl. ..... 36/30 R; 36/11.5; 12/146 B; 12/142 S

(58) Field of Search ..... 36/11.5, 28, 29, 36/43, 44, 30 R, 31; 12/146 B, 142 S

(56) References Cited

U.S. PATENT DOCUMENTS

| | | | | |
|---|---|---|---|---|
| 2,715,285 A | | 8/1955 | Del Vecchio | |
| 2,744,340 A | * | 5/1956 | Gerber | 36/11.5 |
| 3,724,106 A | * | 4/1973 | Magidson | 36/44 |
| 4,124,946 A | * | 11/1978 | Tomlin | 36/11.5 |
| 4,346,205 A | | 8/1982 | Hiles | |
| 4,476,258 A | * | 10/1984 | Hiles | |
| 4,535,554 A | * | 8/1985 | De Obaldia | 36/11.5 |
| 4,722,946 A | | 2/1988 | Hostettler | |
| 4,747,219 A | | 5/1988 | Ammendolea | |
| 4,833,795 A | | 5/1989 | Diaz | |
| 4,977,691 A | * | 12/1990 | Orchard, 3rd | 36/44 |
| 5,155,927 A | | 10/1992 | Bates et al. | |
| 5,203,793 A | | 4/1993 | Lyden | |
| 5,362,834 A | | 11/1994 | Schapel et al. | |
| 5,392,532 A | | 2/1995 | Bray, Jr. et al. | |
| 5,493,792 A | | 2/1996 | Bates et al. | |
| 5,553,399 A | | 9/1996 | Strong | |
| 5,555,584 A | | 9/1996 | Moore, III et al. | |
| 5,713,143 A | | 2/1998 | Kendall | |
| 5,718,063 A | | 2/1998 | Yamashita et al. | |

* cited by examiner

*Primary Examiner*—M. D. Patterson
(74) *Attorney, Agent, or Firm*—Merchant & Gould P.C.

(57) ABSTRACT

Disclosed is a slipper having an outsole, an insole and an upper attached to the outsole. The outsole includes a bottom wall and a perimeter wall extending from the bottom wall to provide a polymer insole jell receiving area. The insole includes a polymer insole jell and is provided within the polymer jell insole receiving area of the outsole. The polymer insole jell can be formed within the polymer insole jell receiving area, or the polymer insole jell can be preformed and placed within the polymer insole jell receiving area. Also disclosed is a method for manufacturing a slipper.

15 Claims, 2 Drawing Sheets

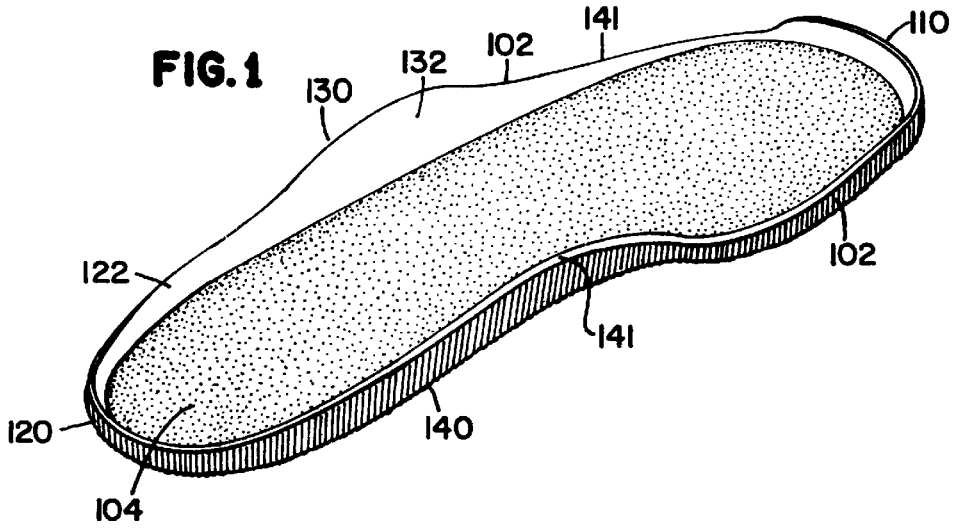
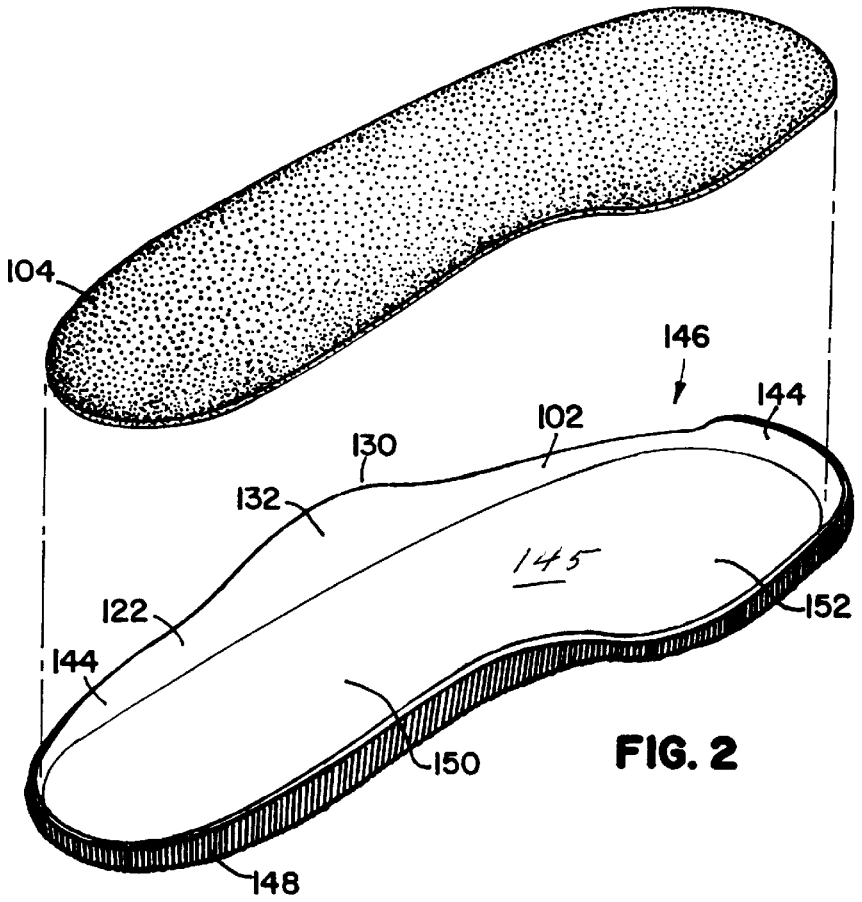
FIG. 2

SLIPPER WITH POLYMER INSOLE JELL AND METHOD FOR MANUFACTURING

FIELD OF THE INVENTION

The invention relates to a slipper having a polymer insole jell, and to a method of manufacturing a slipper having a polymer insole jell. In particular, the polymer insole jell is a polyurethane polymer which provides a slipper with cushioning.

BACKGROUND OF THE INVENTION

Slippers often include a foam insole to provide a soft and cushioned feel for the foot. In contrast to formal shoes and athletic shoes, slippers generally provide significantly less support, but can be very comfortable to wear.

Polymer materials have been used in certain types of footwear to provide desired characteristics. Moore III, et al., U.S. Pat. No. 5,555,584, describes a polymer composition that can be used for producing a custom-fitted footbed. Lyden, U.S. Pat. No. 5,203,793, describes customized footwear in which two reactive liquids, once combined, solidify and conform to the shape of the wearer's foot.

Attempts have been made to provide enhanced support and shock absorbing ability of athletic shoes. For example, Bates et al., U.S. Pat. Nos. 5,155,927 and 5,493,792, describe athletic shoes containing a liquid gel that minimizes impact shock and maximizes lateral stability. The liquid gel is able to move between several gated chambers present within the shoe. Diaz, U.S. Pat. No. 4,833,795, describes an athletic shoe including hollow ribs that provides shock absorption.

SUMMARY OF THE INVENTION

A slipper is provided by the invention. The slipper includes an outsole, an upper, and an insole. The outsole includes a bottom wall and a perimeter wall. Both the bottom wall and the perimeter wall include an interior surface and an exterior surface. The perimeter wall extends upwardly from the interior surface of the bottom wall, and the combination of the interior surface of the perimeter wall and the interior surface of the bottom wall form a polymer insole jell containing area. The upper is attached to at least a portion of the outsole, preferably the perimeter wall, and extends from the outsole to provide a foot receiving area. The insole includes a polymer insole jell, and the polymer insole jell is provided within the polymer insole jell containing area of the outsole. The insole can additionally include a foam layer provided covering the polymer insole jell. The slipper can additionally include a sock provided covering the polymer insole jell or the foam layer covering polymer insole jell. The sock is preferably attached to the outsole, and preferably to the perimeter wall.

The polymer insole jell can be characterized as having a Shore 00 value of less than about 75, a compression set of less than about 15%, and an elongation to break of at least about 500%. Preferably, the polymer insole jell is a polyurethane polymer. Preferably, the polymer insole jell has a thickness of between about 1 mm and about 10 mm. The polymer insole jell can be adhered to the outsole along the interior surfaces of the bottom wall and the perimeter wall.

Methods for manufacturing a slipper are provided by the invention. The method can include placing a mixture of polymer precursors within the polymer insole jell containing area, and reacting the polymer precursors to provide the polymer insole jell. The mixture of polymer precursors preferably has a viscosity of between about 1 and about 1000 poise when placed in the polymer insole jell containing area. Alternatively, the polymer insole jell can be preformed and cut, and then placed within the polymer jell containing area of the outsole. If desirable, a foam insole can be provided covering the polymer insole jell. A sock is provided covering the polymer insole jell or the combination of the polymer insole jell and the foam insole, and the sock can be sewn to the outsole along the perimeter wall. An upper can be sewn to the outsole along a portion of the perimeter wall to provide a foot receiving area.

BRIEF DESCRIPTION OF THE FIGURES

FIG. 1 is a perspective view of a molded outsole and a polymer insole jell provided according to the invention;

FIG. 2 is an exploded perspective view of the molded outsole and polymer insole jell of FIG. 1.

DETAILED DISCUSSION

Figure 3:
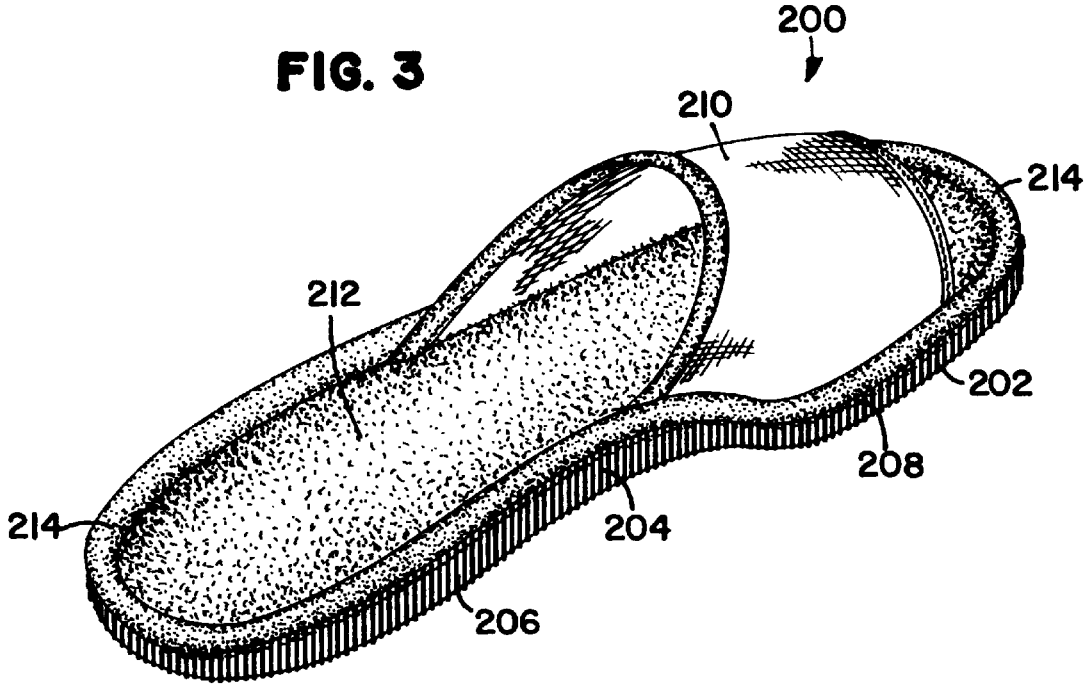
FIG. 3 is a perspective view of a slipper according to the invention.

The present invention relates to a slipper having an polymer insole jell. The polymer insole jell can be used in a slipper in place of a conventional foam insole, or it can be used in combination with a traditional foam insole. When used in combination with a conventional foam insole, the foam insole is preferably provided covering the polymer insole jell. The polymer insole jell is preferably provided as a layer of polymeric material having jell properties. That is, the polymer insole jell can be characterized as soft and exhibiting viscoelastic properties. The polymer insole jell will deform to a certain extent when compressed by the force of a person's weight, and the jell will generally regain its shape once the pressure has been removed. In general, the polymer insole jell provides a slipper with enhanced cushioning and comfort.

The polymer insole jell can be formed or placed in a slipper outsole having a raised perimeter wall. A preferred outsole which can be used according to the invention is described in U.S. Pat. No. 5,392,532 to Bray, Jr., et al., which is assigned to R. G. Barry Corporation of Columbus, Ohio, the assignee of the above-identified patent application. U.S. Pat. No. 5,392,532 is incorporated herein by reference. The slipper outsole described by U.S. Pat. No. 5,392,532 includes a perimeter wall which permits sewing of the upper to the outsole along the perimeter wall. In addition, the perimeter wall prevents the polymer insole jell from flowing outside of the slipper when compressed by the pressure of a wearer's weight. An alternative outsole design which can be used according to the invention is described by U.S. patent application Ser. No. 29/081,923, which was filed on Nov. 7, 1997. The entire disclosure of U.S. patent application Ser. No. 29/081,923 is incorporated herein by reference.

Now referring to FIGS. 1 and 2, an outsole 102 and polymer insole jell 104 are shown. The outsole 102 and the polymer insole jell 104 are shown having a forward end 110, a rearward end 120, a first side 130, and a second side 140. The outsole 102 has a perimeter wall 122 that contains the polymer insole jell 104. In the embodiment shown, the perimeter wall 122 includes a raised portion 132 that extends above the rest of perimeter wall 122. It should be appreciated that the invention can be practiced without the raised portion 132. The perimeter wall 122 can be provided extending around the entire circumference of the outsole 102 at a relatively uniform or constant height. Of course, the height of the perimeter wall 122, or any portion of the perimeter wall 122, can be varied for aesthetics or other design considerations. The height of the perimeter wall should be sufficient to contain the polymer insole gel 104 within the outsole 102. It should be appreciated that the outsole 102 need not include a cover for containing the polymer insole gel within the outsole. That is, the outsole can be characterized as being open at the top because the polymer insole gel is not contained within an enclosed chamber in the outsole. In addition, the perimeter wall 122 includes a top surface 141.

The outsole 102 includes a bottom wall 145 which includes an interior bottom surface 150 and an exterior bottom surface (not shown). The outsole 102 additionally includes a perimeter wall 122 having an interior wall surface 144 and an exterior wall surface 148. The interior wall surface 144 extends from the interior bottom surface 150, and the combination of the interior wall surface 144 and the interior bottom surface 150 provide the polymer insole jell receiving area 152. The bottom surface 150 and the interior wall surface 144 can be characterized as a mold 146 for receiving the liquid polymer precursors used to form the polymer insole jell 104.

The polymer insole jell 104 is provided with a thickness which is sufficient to provide a desired level of cushioning. If the polymer insole jell 104 is too thin, it will not provide a desired level of cushioning. If polymer insole jell 104 is too thick, manufacturing difficulties could arise. In addition, while a thick polymer insole jell would provide adequate comfort, it may fail to provide adequate support. The polymer insole jell 104 is preferably between about 1 mm and about 10 mm thick.

Now referring to FIG. 3, a slipper according to the invention is indicated at reference numeral 200. The slipper 200 includes an outsole 202 having a perimeter wall 204. The portion of the outsole 202 shown is the wall exterior surface 206.

The slipper 200 includes an upper 210 sewn along a length of the outsole 202, and preferably along a length of the perimeter wall 204 along the stitch line 208. In addition, a sock 212 is shown covering the polymer insole jell. The polymer insole jell is not shown but is provided between the sock 212 and the outsole 202. Preferably, the sock 212 directly covers the polymer insole jell, or a foam insole can be provided between the sock 212 and the polymer insole jell. In addition, cording 214 is provided along the perimeter wall 204 to provide a finished appearance. The cording 214 is stitched to the perimeter wall 204 along the stitch line 208.

The slipper 200 is shown as an open toe design. It should be appreciated that the slipper according to the invention can be provided as a closed toe design if the upper is provided enclosing the toe region. In addition, the upper can be provided extending around the heel region, if desired. The sock, upper, and cording can be prepared from conventional foam and fabric materials conventionally used in the manufacture of slippers. In general, it is desirable to cover the perimeter wall top surface 141 with a fabric material to provide a finished appearance.

The polymer insole jell is preferably made of a soft polyurethane polymer. Preferably, the polyurethane polymer has a hardness value measured on the Shore 00 scale of less than about 75, more preferably less than about 35, and even more preferably less than about 25. The polymer insole jell has a Shore 00 value which is greater than zero. The hardness of elastomeric materials are frequently tested using a Shore A Scale Durometer, as described in ASTM D 2240. The Shore Durometer uses a short indentor (0.098 inches in length) that is pressed onto a sample by an 822 gram spring. Each 0.001 inch of deflection is shown as 1 degree Shore A. As the material tested becomes harder, the amount of deflection (and therefore the Shore value) increases. The Shore 0 scale is used for testing materials below 10 degrees while the Shore 00 scale is used for testing materials registering 10 or less on the Shore 0 scale. The Shore 00 scale requires use of a spherical indentor and a 225 gram spring. A suitable sample is about 6 millimeters thick and has a surface area sufficient to permit at least three test points that are at least 5 millimeters apart and at least about 13 millimeters from any edge.

Polymers having Shore 00 values below about 75 are easily deformed yet rapidly recover their initial shape once released. Preferably, the polymer insole jell has an elongation to break value of at least about 500 percent. This is an indication of the elasticity of the polymer. The polymers used in the present invention can preferably be stretched to at least 5 times their original size. Preferably, the polymer insole jell used have a compression set of less than about 15 percent. A compression set of less than about 15 percent means that the polymer will regain at least about 85 percent of its original shape or size once the deforming force is removed.

Polyurethane polymers are formed from the reaction of isocyanate containing components and active hydrogen-containing components. Preferably, the hydrogen-containing components are polyols. Polyurethanes which can be used according to the invention can be produced by mixing polyols and polyisocyanates at ambient temperature in a mixing head. At the exit of the mixing head, the chemical mixture is a liquid with a viscosity between about 1 and 1000 poise. The polyols and isocyanates react together in an exothermic reaction to form a cross-linked network of polyurethane polymer. No heat needs to be added; so manufacturing costs can be kept low. Examples of suitable polymers and the synthesis thereof are described in U.S. Pat. Nos. 4,346,205, 4,722,946, and 5,362,834, the disclosures of these patents being hereby incorporated by reference. Commercially available polymers are available from such companies as Pittsburgh Plastics, Sorbothane, Viscolas, and Bayer. A low hardness grade polymer useful according to the invention is available under the name ISOGEL®.

According to the invention, polymer forming components can be mixed and poured into a slipper outsole having sidewalls forming a mold. The polymer forming components can react to form the polymer insole jell. Preferably, the polymer insole jell bonds to the outsole. The outsole is typically a low-density polyolefin or styrene block copolymer, such as exemplified by the Kraton® materials produced by Shell. Adherence between the outsole and the polymer insole jell simplifies manufacture. A foam layer may or may not be added over the layer, but in either case the upper portion of the slipper, including a fabric top cover over the polymer insole jell can be directly sewn to the outsole, or sewn to a material or fabric (such as cording) which is sewn directly to the outsole. It should be appreciated that a material such as cording can be considered an upper when used to connect the vamp to the outsole.

As described above, a preferred embodiment for forming the polymer insole jell includes reacting polyurethane forming precursors in an outsole to provide a polyurethane polymer which cures to form a gel-like soft elastomer. An alternative embodiment of the invention includes dye cutting a pre-formed sheet of the gel-like soft elastomer and dropping the die cut material into an outsole. In addition, the dye cut gel can be adhesively bonded to the outsole.

Slippers, according to the invention, can be characterized as being different from formal shoes and athletic shoes. In general, the slippers according to the invention are intended to be used primarily indoors, and are designed to provide comfort a;rather than support. In contrast, formal shoes and athletic shoes are generally intended to be used in an outdoors environment. Although formal shoes and athletic shoes can be designed to provide comfort, they are generally designed to provide the wearer's foot with support under the conditions in which they are to be used. Accordingly, there are many features commonly found in formal shoes and athletic shoes which can be excluded from the slippers according to the invention. For example, formal shoes and athletic shoes generally include laces or straps for holding the shoes to a wearer's foot. Slippers, according to the invention, can exclude the laces and straps of prior art shoes which are designed to hold the shoes to a wearer's foot.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A slipper comprising:

(a) an outsole comprising a bottom wall and a perimeter wall extending continuously around the bottom wall perimeter, said bottom wall including an interior surface and an exterior surface, said perimeter wall including an interior surface and an exterior surface, said perimeter wall extending upwardly from the interior surface of said bottom wall, and the interior surface of said perimeter wall and the interior surface of said bottom wall forming a polymer insole jell containing area;

(b) an upper attached to at least a portion of the perimeter wall, said upper extending from said perimeter wall to provide a foot receiving area; and (c) an insole comprising:

(i) a polymer insole jell provided within the polymer insole jell containing area, the polymer insole jell prepared by reacting polymer precursors to provide a polymer insole jell having a Shore 00 value of less than about 75; and (ii) a sock covering the polymer insole jell, wherein the sock comprises a fabric layer that is attached to the perimeter wall along the entire perimeter wall.

2. A slipper according to claim 1, wherein the upper attaches along a portion of a length of the perimeter wall to provide a slipper having a closed toe design.

3. A slipper according to claim 1, wherein the polymer insole jell has a Shore 00 value of less than about 35.

4. A slipper according to claim 1, wherein the polymer insole jell has a Shore 00 value of less than about 25.

5. A slipper according to claim 1, wherein the polymer insole jell is a polyurethane polymer.

6. A slipper according to claim 1, wherein the polymer insole jell has a compression set of less than about 15 percent.

7. A slipper according to claim 1, wherein the polymer insole jell has an elongation to break value of at least about 500 percent.

8. A slipper according to claim 1, wherein the polymer insole jell has a thickness of between about 1 mm and 10 mm.

9. A method for manufacturing a slipper, the method comprising steps of:

(a) providing an outsole comprising a bottom wall and a perimeter wall extending continuously around the bottom wall perimeter, the bottom wall including an interior surface and an exterior surface, the perimeter wall including an interior surface and an exterior surface, said perimeter wall extending upwardly from the interior surface of said bottom wall, and the interior surface of said perimeter wall and the interior surface of said bottom wall forming a polymer insole jell containing area;

(b) mixing polymer precursors to form a liquid mixture of polymer precursors, the mixture having a viscosity of between about 1 and 1000 poise;

(c) placing the mixture of polymer precursors within the polymer insole jell containing area and allowing the mixture of polymer precursors to react to form a polymer insole jell;

(d) attaching a sock comprising a fabric layer to the perimeter wall of the outsole along the entire perimeter wall so that the sock covers the polymer insole jell; and (e) attaching an upper to the perimeter wall of the outsole.

10. A method for manufacturing a slipper according to claim 9, further comprising a step of providing a foam insole covering the polymer insole jell.

11. A method for manufacturing a slipper according to claim 9, wherein the polymer insole jell has a Shore 00 value of less than about 75.

12. A method for manufacturing a slipper according to claim 9, wherein the polymer insole jell has a compression set of less than about 15%.

13. A method for manufacturing a slipper according to claim 9, wherein the polymer insole jell has an elongation to break value of at least about 500%.

14. A method for manufacturing a slipper, the method comprising steps of:

(a) providing an outsole comprising a bottom wall and a perimeter wall extending continuously around the bottom wall perimeter, the bottom wall including an interior surface and an exterior surface, the perimeter wall including an interior surface and an exterior surface, said perimeter wall extending upwardly from the interior surface of said bottom wall, and the interior surface of said perimeter wall and the interior surface of said bottom wall forming a polymer insole jell containing area;

(b) providing a polymer insole jell within the polymer insole jell containing area, said polymer insole jell having a Shore 00 value of less than about 75;

(c) providing a sock covering the polymer insole jell and attaching the sock to the perimeter wall of the outsole along the entire perimeter wall, wherein the sock comprises a fabric layer; and (d) attaching an upper to the perimeter wall of the outsole.

15. A method for manufacturing a slipper according to claim 14, further comprising a step of placing a foam insole within said slipper covering the polymer insole jell so that the sock covers the foam insole.

* * * * *